US008468722B2

(12) United States Patent
Battlogg et al.

(10) Patent No.: US 8,468,722 B2
(45) Date of Patent: Jun. 25, 2013

(54) SHOE, IN PARTICULAR RUNNING SHOE OR SKI BOOT, AND SKIING EQUIPMENT

(75) Inventors: Stefan Battlogg, St. Anton/Montafon (AT); Jürgen Pösel, Bludenz (AT)

(73) Assignee: Inventus Engineering GmbH, St. Anton/Montafon (AT)

( * ) Notice: Subject to any disclaimer, the term of this patent is extended or adjusted under 35 U.S.C. 154(b) by 438 days.

(21) Appl. No.: 12/814,814

(22) Filed: Jun. 14, 2010

(65) Prior Publication Data

US 2010/0251574 A1 Oct. 7, 2010

Related U.S. Application Data

(63) Continuation of application No. PCT/AT2006/000329, filed on Aug. 3, 2006, and a continuation-in-part of application No. 12/024,618, filed on Feb. 1, 2008, now abandoned.

(30) Foreign Application Priority Data

Aug. 3, 2005 (AT) ..... A 1309/2005

(51) Int. Cl.
*A43B 2/14* (2006.01)

(52) U.S. Cl.
USPC ..... 36/88; 36/117.1; 36/93

(58) Field of Classification Search
USPC ..... 36/117.1, 88, 93, 29
See application file for complete search history.

(56) References Cited

U.S. PATENT DOCUMENTS

| | | | | |
|---|---|---|---|---|
| 6,557,272 | B2 * | 5/2003 | Pavone | 36/29 |
| 6,875,241 | B2 | 4/2005 | Christesen | |
| 6,875,242 | B2 | 4/2005 | Christensen | |
| 7,007,412 | B2 * | 3/2006 | Munster | 36/132 |
| 7,200,956 | B1 * | 4/2007 | Kotha et al. | 36/29 |
| 7,204,041 | B1 * | 4/2007 | Bailey et al. | 36/29 |
| 7,254,908 | B2 * | 8/2007 | Ungari | 36/29 |
| 7,395,614 | B1 * | 7/2008 | Bailey et al. | 36/28 |
| 2004/0002665 | A1 | 1/2004 | Parihar et al. | |
| 2006/0248750 | A1 * | 11/2006 | Rosenberg | 36/29 |

FOREIGN PATENT DOCUMENTS

| | | |
|---|---|---|
| DE | 1962632 | 6/1971 |
| DE | 10240530 A1 | 3/2004 |
| WO | 0047072 A2 | 8/2000 |
| WO | 2004071225 A2 | 8/2004 |

OTHER PUBLICATIONS

International Search Report dated Nov. 29, 2006.

* cited by examiner

*Primary Examiner* — Marie Patterson
(74) *Attorney, Agent, or Firm* — Laurence A. Greenberg; Werner H. Stemer; Ralph E. Locher

(57) ABSTRACT

A shoe contains an adjustable space for the foot and several fluidically connected chambers. In order to adjust the space for the foot, the flowability of a magnetorheological fluid can be influenced by one or more devices that generate a magnetic field and thereby adjust the space for the foot resulting in a better fitting of the shoe. The novel system may also be implemented in orthoses (e.g., pronation correction) or in complete shoes with orthotics devices for correcting musculoskeletal abnormalities.

25 Claims, 9 Drawing Sheets

SHOE, IN PARTICULAR RUNNING SHOE OR SKI BOOT, AND SKIING EQUIPMENT

CROSS-REFERENCE TO RELATED APPLICATIONS

This application is a continuation-in-part of our copending application Ser. No. 12/024,618, filed Feb. 1, 2008, which was a continuation, under 35 U.S.C. §120, of our international application No. PCT/AT2006/000329, filed Aug. 3, 2006, which designated the United States; this application also claims the priority, under 35 U.S.C. §119, of Austrian patent application No. A 1309/2005, filed Aug. 3, 2005; the prior applications are herewith incorporated by reference in their entirety.

BACKGROUND OF THE INVENTION

Field of the Invention

The invention relates to a shoe, in particular a ski boot, having a variable foot area and having a magnetorheological fluid, whose capability to flow can be influenced for varying the foot area by at least one device for producing a magnetic field. The invention also relates to skiing equipment, having a ski with a ski binding, a ski pole and a shoe such as this.

A shoe for matching to a foot shape is described for example, in published, non-prosecuted German patent application DE 19 62 632 A. The closed shoe can be matched to the foot shape by virtue of the flexibility of a cushion, such that the compound that can flow is moved from areas in which the pressure on the foot is greater into areas in which the pressure is lower. Since the aim is for the shoe to surround the foot as firmly as possible, in order to prevent relative movements between the shoe and the foot, the compound that can flow must move only slowly. The compound that can flow is therefore a high-viscosity liquid or has low viscosity and is forced through flow-restricting constrictions when being moved.

In order to allow the shoe to react over the course of time to changes in the volume of the foot as well after its adaptation when being fitted, it is possible, for example, for the height of the inner sole to be adjustable or, in particular, for a supply container for the liquid to be provided in the sole, which is linked such that flow can pass to the cushion or the cushion via lines, such that the amount of liquid contained in the cushion can be varied. Control and actuating devices that are required for this purpose are preferably likewise accommodated in the sole of the shoe.

International patent publication WO 00/47072 discloses the use of an inner sole or an insert sole with a continuous cushion or a cushion which is provided only in the toe or heel area in a ski boot or roller skating shoe, which cushion contains a liquid whose capability to flow is varied under the influence of a magnetic field. At least a part of a device for producing the magnetic field is for this purpose also preferably disposed adjacent to or in the shoe. In the case of a ski boot, parts of the device may also be provided, for example, on the ski binding.

Magnetorheological fluids (MRF) or MR liquids, are fluids—typically in liquid phase—are distinguished by an increase in their apparent viscosity under the influence of a magnetic field. Without the influence of a field, they generally have a low viscosity and, under the influence of a field, they could be considered to be solid bodies provided that the field-strength-dependent limiting shear stress is not exceeded.

They are formed of a basic liquid and solid particles which are ferromagnetic. The proportion by volume of the solid particles is in this case between 20% and 60%. Chains with branches of greater or lesser strength of these solid particles are responsible for the increase in the viscosity. These are held together by magnetic forces between the particles. Shearing of the fluid first of all results in strain and, as the shear stresses become higher, in the chains being torn open. Continuous recombination of the broken chain pieces ensures that the increased viscosity is in principle maintained under the influence of a field, even at relatively high shear rates. Experiments have shown that a liquid dynamic viscosity of more than 10 Pa·s is advantageous for use in shoes.

Both liquids have already been known for a relatively long time and are used, for example, in shock absorbers and torque converters. Recently, a magnetorheological fluid has also become known in the form of a gel.

In principle, electrorheological fluids (ERF) or liquids can also be used for this purpose. Electrorheological fluids have a lower relative density, but require a higher voltage to change the capability to flow that, for example, can be applied to the liquid via electrodes. Since, in the case of shoes, higher voltages are dependent on corresponding, independent energy sources, magnetorheological fluids are considerably more suitable for these and other mobile applications.

The use of magnetorheological fluids would ideally allow occasional or else frequent, rapid matching of the foot area to the instantaneous shape of the foot, foot retention and foot position, with the foot being firmly surrounded by the shoe, held to the desired extent, and without any pressure points after each matching process, again. However, the solution described in WO 00/47042 does not achieve this since it is not possible to achieve that degree of variability that is required for matching to the relatively complicated geometry and three-dimensional shape of a foot. Furthermore, magnetorheological fluids have a rather high relative density because of the ferromagnetic particles, so that only a limited amount of liquid can be used, even for ski boots.

BRIEF SUMMARY OF THE INVENTION

It is accordingly an object of the invention to provide a shoe, in particular a ski boot, and skiing equipment that overcomes the above-mentioned disadvantages of the prior art devices of this general type.

With the foregoing and other objects in view there is provided, in accordance with the invention, a shoe. The shoe comprises:

one or more deformable chambers disposed to vary a shape and/or a volume of a foot space in the shoe;

one or more flow links fluidically connected to the respective deformable chambers;

magnetorheological fluid (MRF) in the one or more deformable chambers and in the flow link(s); and at least one magnet device for generating a magnetic field, the magnet device being disposed to subject at least one of the flow links and the deformable chambers to the magnetic field, the magnet device selectively influencing a viscosity of the magnetorheological fluid and varying the shape and/or the volume of the foot space by varying the magnetic field.

In one embodiment, there are provided a plurality of flow-linked chambers instead of a single chamber surrounding the major parts of the foot. Since intermediate spaces remain even with a relatively tight arrangement, the total volume of the chambers is in any case less than that of a single large chamber. However, somewhat larger intermediate spaces are preferably provided, and the chambers are combined into units which, for example, are similar to bubble-wrap sheets used for packing purposes.

A plurality of small chambers not only make it possible to reduce the weight but also allow a preferred embodiment in which the magnetic fields are applied only to the lines or to the flow links, such that only that magnetorheological fluid which is located in the flow links is solidified, then impeding the movement of the liquid which is enclosed in the chambers. If the flow links are of adequate length, a further preferred embodiment provides for the magnetorheological fluid in each flow link to be enclosed by two sealing elements which can move in the flow link, and to be separated from a different compound, which can flow, in the chambers.

The liquid enclosed in the chambers can in this embodiment be lighter and, for example, may be a basic magnetorheological fluid without magnetic solid particles or water, thus not only making it possible to save weight but also costs, since magnetorheological fluids are relatively expensive. The liquid enclosed in the chambers may also contain lightweight filling particles, for example spheres composed of plastic or the like, which can additionally also contribute to better thermal insulation.

In a further preferred embodiment, a constriction is formed in the flow link and is disposed approximately centrally in the magnetic field, so that the magnetorheological fluid solidifies to form a plug that surrounds the constriction on both sides, in an interlocking form. The fixing in the flow direction could also be improved by making the inner wall of the flow link uneven, rough, or providing it with projections. In order to make use of the magnetic forces and the energy available with as high an efficiency as possible, the important factor is for the magnetic field lines to pass through the flow links at right angles to the direction in which the magnetorheological fluid flows.

There are various options for practical implementation. The chambers may be connected in series, which is to say a line extends from a supply container through the chambers back to the supply container. The flow links to be connected are located between the chambers or the supply container and the first and last chambers. This requires a greater number of devices for producing magnetic fields, preferably adjacent to each flow link. Permanent magnets are more suitable for this purpose, so that there is no need for electrical lines. However, electromagnets may, of course, also be used.

Another option is for the design to be configured such that one line originates from the supply container per chamber, and each line or flow link has an associated device for producing a magnetic field. This embodiment can be implemented quite advantageously with permanent magnets or electromagnets if all of the flow links to be influenced are provided, for example, in an area close to the supply container.

If flow links can be influenced in the same way in groups, then they can be subjected to common magnetic fields. When the flow links are disposed in series, for example, elongated permanent magnets may surround all the flow links which are connected in a row. If the lines run individually to each chamber, then the joint common influence, as described above, can be produced in an area close to the supply container, in which a plurality or all of the lines are located parallel alongside one another, as long as at least one device for producing a magnetic field is provided there. By way of example, this may once again have an elongated permanent magnet that surrounds the lines. A common electromagnet can, of course, also be used in this case.

If permanent magnets are provided, then the magnetorheological fluid is located in a constant magnetic field, and the flow links that are subject to the magnetic field are solidified.

It will be understood that the term "magnet device," as used herein, includes a variety of implementations. We include any device that is capable of generating a magnetic field and thus any permanent magnet, electrical coils, remanence systems, or variations of these. Similarly, as will be described in detail, the term "flow link" is any valve device, flow conduit, channel, restriction, outlet duct, or the like, which connects to a chamber. The flow link is typically a small volume connection that allows a reasonable powerful magnetic field to completely and easily influence the viscosity inside the link within a great range, from liquid to quasi-solid phase. The surface of the flow link need not be smooth, it may also be rough or uneven, it may be formed with a surface structure, it may extend along a zig-zag course, or it may be otherwise uneven. The transition from the chamber to the flow link may be a funnel, it may have a ramp or it may have any other suitable form.

In order now to change the foot area as required, a first embodiment provides for the permanent magnet to be disposed such that it can be moved relative to the flow link in the shoe in order to attenuate or deactivate the magnetic field. In order to attenuate or deactivate the magnetic field, thus allowing compensation between the variable-shaped chambers and the supply container, the permanent magnet in a cylindrical embodiment in the form of a rod can be rotated such that the magnetic field lines no longer run at right angles through the flow link, or are extracted from a pocket of the shoe. As soon as the foot area has been matched, the permanent magnets are rotated back, or are inserted again.

Another preferred option is for the permanent magnet to have an associated moveable magnetic shield in order to attenuate or deactivate its magnetic field. The effect that can be achieved in this way is similar, but the shield which, for example, is in the form of a plate, is rotated or removed, instead of the permanent magnet.

One alternative embodiment provides for each permanent magnet to have an associated switchable electromagnet that neutralizes, deactivates or reverses the magnetic field of the permanent magnet so that electrical energy is required only for the brief opening of the flow links that is necessary to reshape the chambers.

If sufficient amounts of electrical energy can be made available, then, in a further embodiment, only at least one electromagnet may be provided, which can not only be switched on and off but whose magnetic field intensity can preferably be varied, in particular continuously. When the aim is to match the ski boot, the electromagnet is switched off, so that the magnetorheological fluid can move. Once the ideal fitting shape has been achieved, the electromagnet is energized again.

The supply container preferably likewise represents a chamber that, in particular, is accommodated in the sole of the shoe and may have an associated pump or other pressure generating device.

A generator that converts vibration movements may be provided as the source for electrical energy. A first embodiment of a generator such as this produces a rather low voltage, in accordance with Faraday's induction law, which is suitable for influencing magnetorheological fluids by moving a conductor backwards and forwards relative to a magnetic field. Vibration occurs continuously, particularly when skiing, thus in this way providing more than an adequate amount of electrical energy for a permanently energized electromagnet.

Each of the described "vibration generators" preferably has associated control electronics and an associated energy store, for example a rechargeable battery or a capacitor. The generator for producing the electrical energy may, in particular, be disposed adjacent to the rear face or adjacent to the upper face of the ski boot, angled upwards. Particularly when skiing, the continuous vibration results in excess electrical energy, which can also in this case be used to heat the shoe or to feed other loads.

In another embodiment, a chamber can be provided as a supply container for the liquid and is connected by a feed pump via at least one line to the chamber or to the chambers, so that the pressure in each chamber can also be set and varied, and can also preferably be varied in the various chambers independently of one another. Each chamber may in this case also have an associated sensor.

The control electronics, the energy store, the supply container, the feed pump etc., are preferably accommodated in the sole of the ski boot. User-specific data and skiing-style-specific data can be stored in a data memory so that an appropriate setting for the fitting of the ski boot to the foot can be predetermined. Signals emitted from the sensors can also be used for automatic matching to external conditions, such as the slope state, skiing conditions, and skiing circumstances, etc. It will be understood that the signals may also be transferred by way of a Bluetooth signal, a WLAN protocol signal between the shoes or to other devices (e.g., smart phone, remote control).

Alternatively, however, it is also possible to provide for at least some of these apparatuses to be provided in the ski, in the ski binding or in some other part of the skiing equipment. This makes it possible, for example, for the size of the foot area to be reduced later and not immediately during or after putting on the shoe. This allows the shoe to be used for comfortable walking despite being fitted such that it is stable and fixed while skiing.

A closure flap or the like, for example, can be provided in the heel area or in the area at the front of the foot in order to put the ski boot on. When the closure flap is closed, the foot can be firmly fitted in the shoe for example by operating a conventional buckle, a rotating knob or the like, thus increasing the pressure in the chambers before application of the magnetic fields. In this case, electromagnets can be switched on by a further buckle or the like which can be operated subsequently. If the ski boot contains control electronics, then these electronics can, of course, also be programmed in such a way that the closing of the shoe first of all increases the pressure in the chambers, and then energizes the electromagnets.

Other features which are considered as characteristic for the invention are set forth in the appended claims.

Although the invention is illustrated and described herein as embodied in a shoe, in particular a ski boot, and skiing equipment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
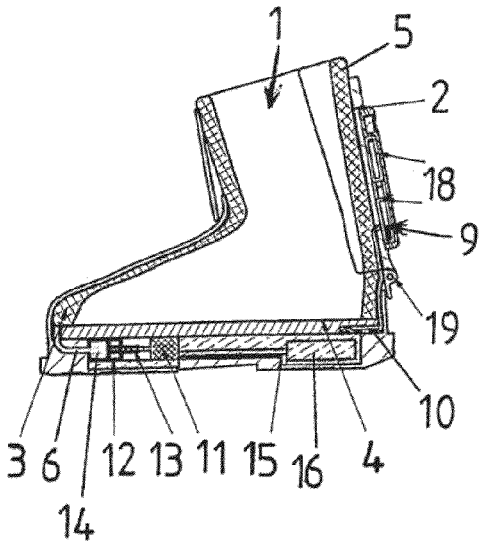
FIGS. 1 and 2 are diagrammatic, sectional views through two different exemplary embodiments of a ski boot according to the invention.

Referring now to the figures of the drawing in detail and first, particularly, to FIG. 1 thereof, there is shown a ski boot according to the invention that preferably has an outer shoe with a relatively thick sole, on which front and rear binding elements act in order to produce the connection to the ski. Internally, the ski boot may be provided additionally with cushioning 5, composed of foam in selected areas, for example adjacent to the rear closure flap 2, which can be rotated about an axis 19 as shown in FIG. 1. A plurality of chambers 3, for example between 10 and 20, are provided at least in pressure-sensitive areas and are filled with a magnetorheological fluid which preferably has a dynamic viscosity of at least 10 Pa·s and solidifies when a magnetic field is applied. It is also possible, but not necessary, for the entire foot area to be enclosed by chambers 3.

Figure 3:
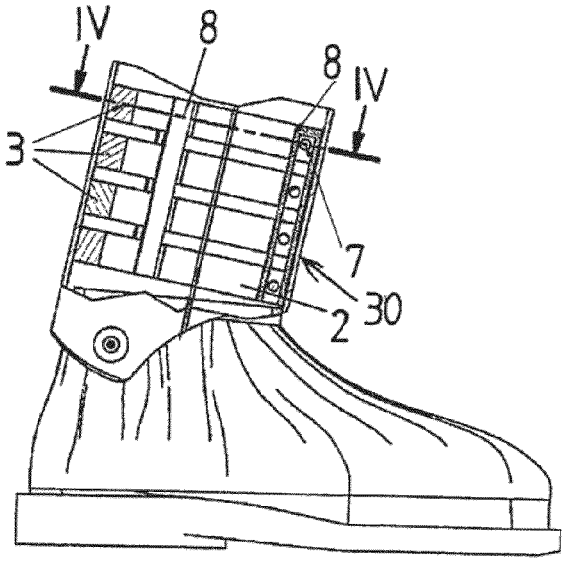
FIG. 3 is a diagrammatic, sectional view through an ankle part of a third embodiment of a ski boot.
Figure 4:
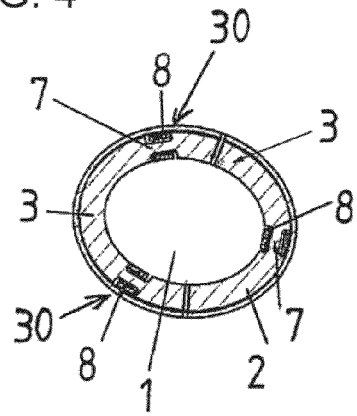
FIG. 4 is a diagrammatic, sectional view taken along the line IV-IV shown in FIG. 3.
Figure 10:
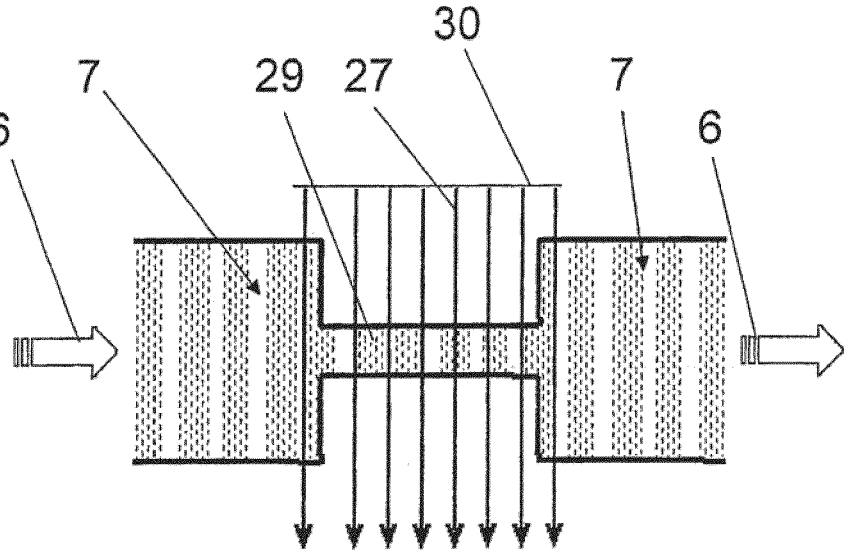
FIG. 10 is an enlarged view of a flow link with a constriction.

FIGS. 3 and 4 schematically illustrate devices 30 for producing a magnetic field, which devices are in the form of permanent magnets 8, with flow links 7 being located in their magnetic fields between the chambers 3. The chambers are disposed in a plurality of rings one above the other in the ankle part of the boot, so that the closure flap 2 that is provided at the front in this embodiment also has chambers 3. The permanent magnets 8 are inserted in pockets that extend to the upper edge of the ankle part of the boot, so that they can be rotated or pulled out upwards in order to vary the foot area 1 and to deform the chambers 3. As soon as the ski boot has been matched to the foot again, the permanent magnets 8 can be rotated back again or pushed in again, as a result of which the magnetorheological fluid circulating in the flow links 7 solidifies again. Alternatively, as is shown schematically in FIG. 11, a magnetic shield 32 can be inserted between the permanent magnets 8 and the flow links 7. Magnetorheological fluid contained in the chambers 3 remains liquid, but cannot move because of the small volume of the chamber 3, which is blocked by the flow links 7. As shown in FIG. 10, the flow links may each have a constriction 29, so that the solidified magnetorheological fluid forms a plug which surrounds the constriction in an interlocking manner. Alternatively or additionally, the inner wall of the flow links 7 may also be uneven or rough. By way of example, the pressure in the chambers 3 can be set conveniently by at least one rotary knob that is not shown, and may also be retained differently, despite subsequent matching with the flow links being influenced in an appropriately variable manner.

Figure 9:
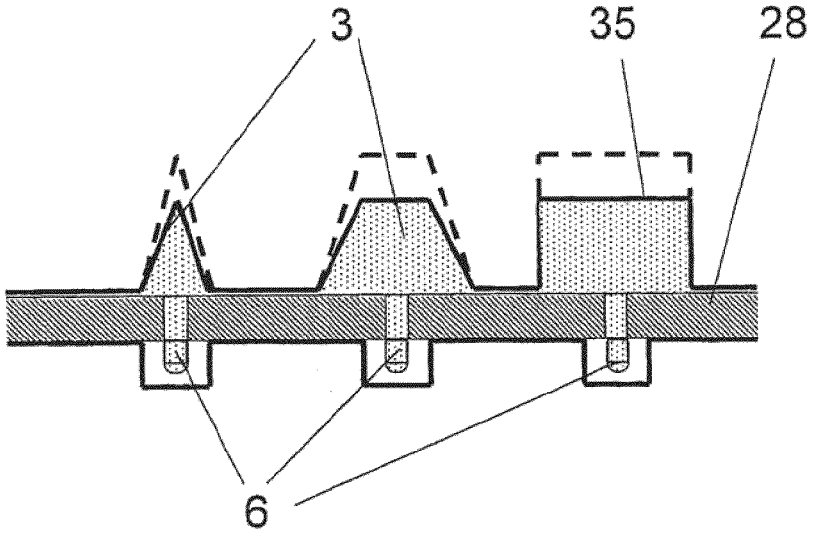
FIG. 9 is a schematic view of a plurality of chambers which can be influenced in parallel.

The chambers 3 may also be composed of a flexible material, which may also be elastic, and, as is illustrated schematically in FIG. 9, may be provided on one side of a mounting panel 28 or the like. The chambers 3 may be identical or else, as is indicated in FIG. 9, may have different shapes. The lines 6 and the flow links 7 which are not shown here, are disposed on the other side of the mounting panel 28 and are passed to the chambers 3 through a respective hole. The chambers 3 may also be disposed one above the other in a plurality of, in particular, offset, layers.

Let us now return to FIGS. 1 and 2, in which the only schematically indicated chambers 3 are associated with the side and front of the foot area 1, and possibly also with the rear, and/or are in the inner sole 4. The chambers 3 are connected to one another and to a supply container 14 via lines 6, which are disposed together with other elements 11, 12, 13, 15 and 16 in the sole, which is normally thick in the case of ski boots. If required, the supply container 14 may itself represent a further chamber. The lines 6 have associated electromagnets, which are not shown, for example in a similar manner to the permanent magnets 8 shown in FIGS. 3 and 4, by which it is possible to vary the capability of the magnetorheological fluid to flow, in the described manner.

An electric motor 11 is also schematically indicated in FIG. 1 and, via a drive shaft 13, operates a piston of a pump 12, by which the magnetorheological fluid can be forced out of the supply container 14 into the chamber 3 in order to match the foot area 1 to the foot, at least on initial use. When used subsequently, for example if the foot is fitting loosely, there are pressure points or it is uncomfortable, the pressure can be reduced or else increased by the pump 12. The motor 11 has associated control electronics 15 and an associated energy store 16, for example a capacitor, an accumulator, a battery, a mini gas turbine, a fuel cell or a vibration generator. By way of example, the pressure can be monitored by at least one sensor, whose signals are processed by the control electronics, thus allowing the ski boot to be automatically matched to the foot.

As FIG. 1 shows, the electrical energy which is required for the electromagnets and other electrical loads, for example shoe heating, can also be produced in the ski boot if, for example, a generator 9 which converts vibration movement is provided adjacent to the rear face, with the vibration causing a permanent magnet and an induction coil to be moved relative to one another. The embodiment illustrated schematically in FIG. 1 shows a generator 9 that has two permanent magnets 18 which move linearly with respect to sprung end stops and have two associated induction coils. The electricity that is generated flows via a line 10 to the energy store 16 and to the motor 11 in the shoe sole.

Figure 2:
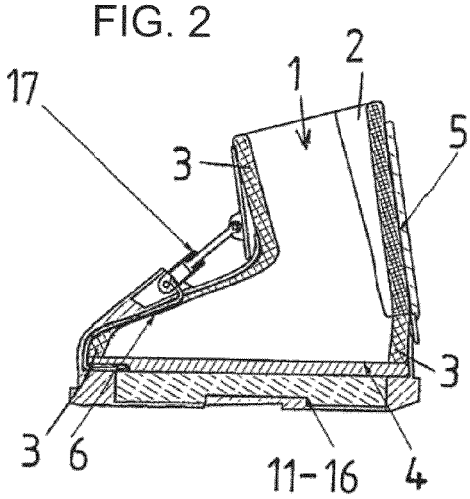

In FIG. 2, which does not show the elements 11 to 16 in the shoe sole in detail, an inclination adjustment device for the ankle part of the boot is disposed adjacent to the front of the boot, with adjustment in the form of a piston-cylinder unit 17, which likewise contains a magnetorheological fluid, which is likewise connected via the line 6 to the supply container 14 in the sole, and likewise has an associated device for producing the corresponding field. This allows the angle of inclination between the sole and the ankle part of the boot to be adjusted from, say, 90° (ideal for walking and standing) to approx. 78° (basic position for alpine skiing, comfort skiing) and to approx. 55° (aggressive skiing, competitive sport skiing). This may be referred to as adaptive flex. These inclination positions can be adjusted directly by the user via an input panel or control panel, or they may be set directly by the control electronics 15 depending on the required settings. It is also possible for the user to "push" the setting by way of the piston/cylinder unit 17 from the basic drive position of approx. 78° to the sporty position of approx. 55°. The electric motor 11, schematically indicated in FIG. 1, operates via a drive shaft 13, a piston of a pump 12, by which the magnetorheological fluid can be forced out of the supply container 14 into the piston-cylinder unit 17. This operating mode is especially advantageous for beginners, because, as they increase their speed and become more sportsy, it is quite typical for them not to bend their knees as much as they should in order to assume a dynamic position with proper weight distribution on the skis.

Similarly, the ankle part can be actively driven from the inclined position, when the user stops, into the upright position, which is much more comfortable for the user. This may be effected automatically, for example, if the integrated motion sensor determines that no skiing motion or movement has been registered for a certain amount of time. Due to the fact that magnetorheologische fluids react within milliseconds, the active, passive, or user-supported and/or user-initiated adjustment may be effected very quickly.

Changing the inclination angle requires that the foot space inside the boot is variable. The foot space, that is the required space and distribution, changes as the relative positions of the foot and the calf change in relation to the inner boot. The piston cylinder unit 17 may be provided in the rear part of the boot or at the pivot points between the ankle part and the lower portion of the boot.

Figure 14:
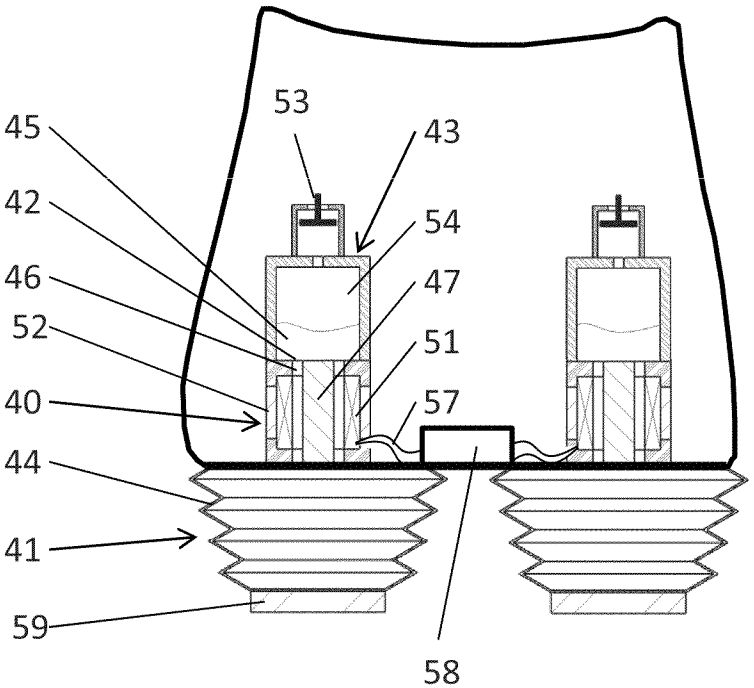
FIG. 14 is a diagrammatic cross-section taken through a running shoe.
Figure 15:
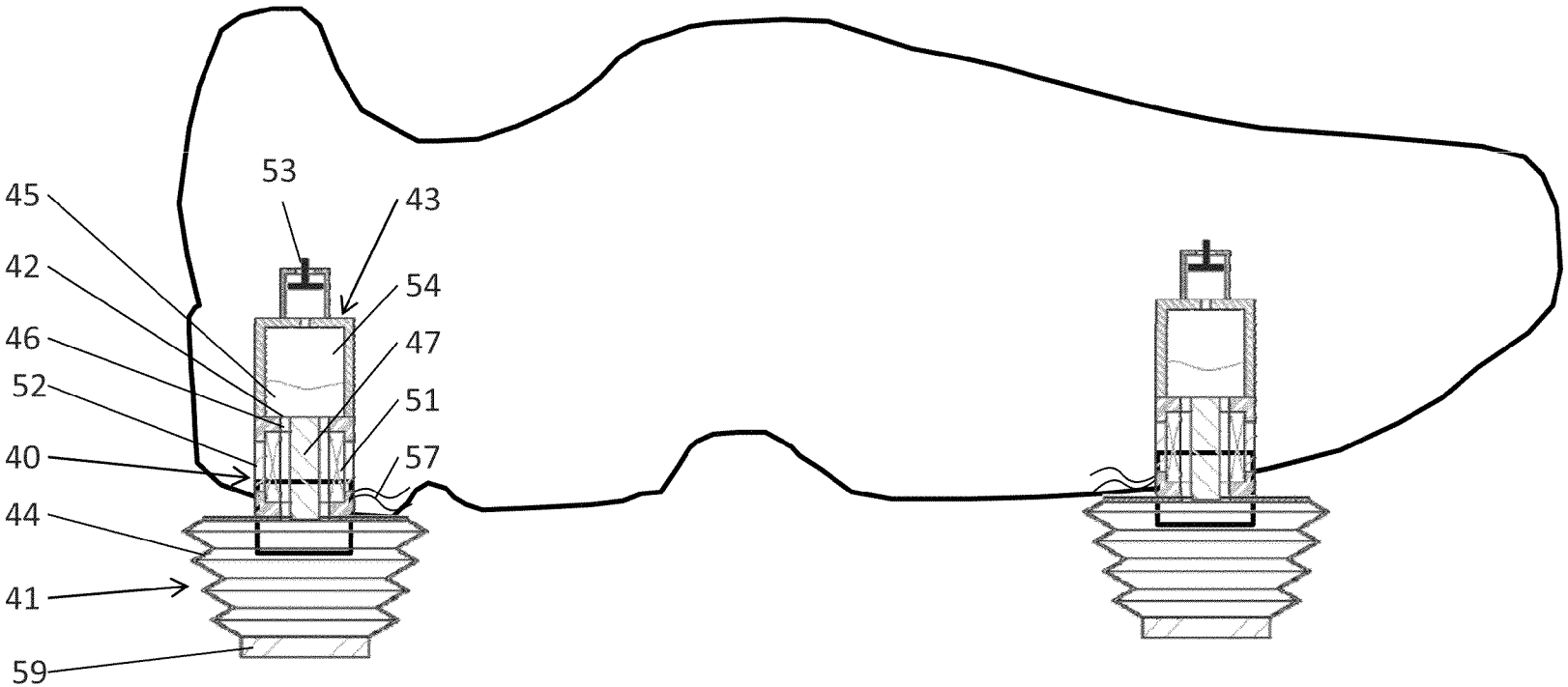
FIG. 15 is a diagrammatic longitudinal section of such a shoe.
Figure 16:
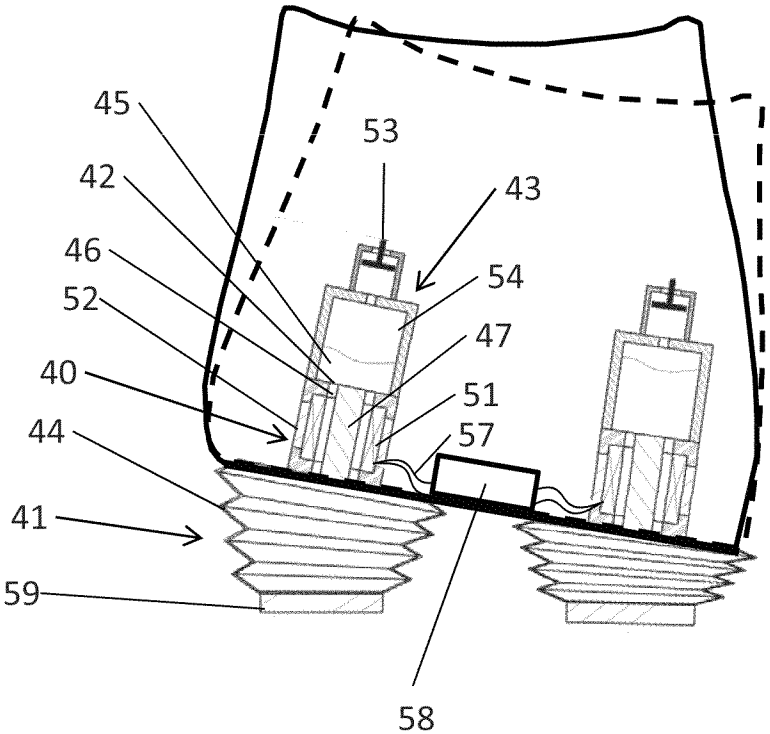
FIG. 16 is a cross-section showing an adjusted position and indicating a further, alternative adjustment position.

The piston cylinder unit 17 may also be formed and configured as illustrated in FIGS. 14, 15, and 16.

In the context of a conventional ski boot the piston cylinder unit 17 may replace the single clamp (e.g. in a rear-entry boot) or the several clamps in a forward-split boot with a tongue. It should be understood that the clamps may be adapted to the specific implementation and they are, thereby, driven and varied according to the requirement. For instance, sporty skiing translates to high clamping forces, walking or standing translates to low clamping forces. As the clamps are varied (i.e., driven) the foot space inside changes and the bracing forces inside the boot, respectively the comfort, adapts accordingly.

Figure 5:
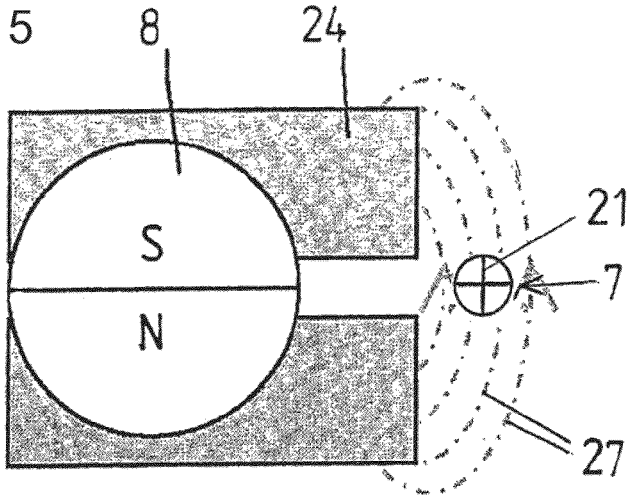
FIG. 5 is a schematic illustration of a mechanically switchable permanent magnet.

FIG. 5 shows, schematically, a configuration of the permanent magnet 8, which is disposed within iron caps 24, which form two magnet poles, such that it can rotate. In the illustrated position, the magnetic field lines 27 of the magnetic field pass through the area close to the poles. The entire arrangement is associated with a flow link 7 between two chambers 3 such that it is located within the magnetic field lines 27. When the permanent magnet 8 is rotated through 90°, for example by an external rotary knob, the magnetic field is moved, and the magnetic field lines run within the two iron caps 24. The flow link 7 in the area close to the poles is therefore located outside the magnetic field, and the magnetorheological fluid that has been solidified in this are can flow again, so that the liquid can move. A plurality of flow links 7 disposed one behind the other can easily be connected in together if the permanent magnet 8 is in the form of a rod.

Figure 6:
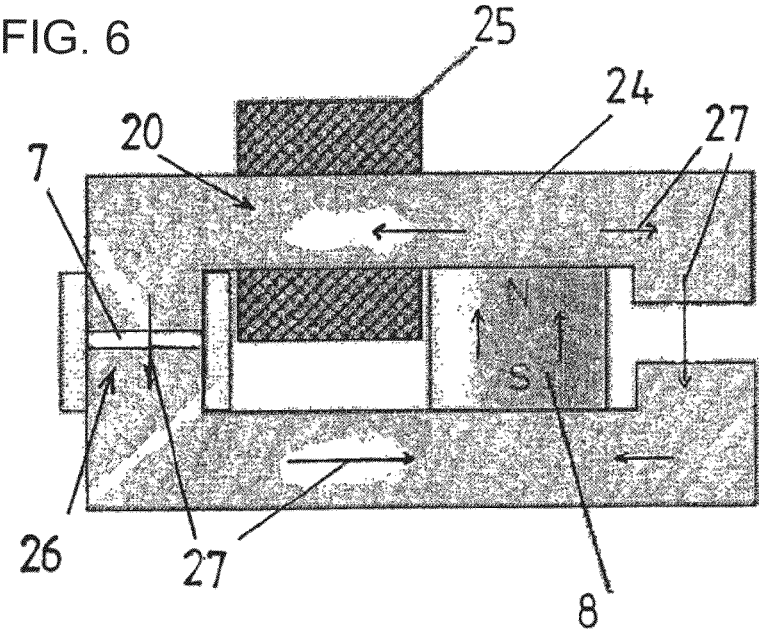
FIG. 6 is a schematic illustration of an electrically switchable permanent magnet.

FIG. 6 shows, schematically, the flow link 7 with a rectangular cross section, which is likewise under the influence of the permanent magnet 8. The magnetic flux is represented by the magnetic field lines 27. The two iron caps 24 have a first pole pair 26 and, on the opposite side, a second pole pair. One of the two iron caps 24 has an associated winding 25. Electrical energy can now be supplied in such a way that the magnetic field produced by the permanent magnet 8 is neutralized, and the magnetic flux no longer runs over the first pole pair 26 but over the second pole pair, averted from the flow link 7. The magnetorheological fluid that has been solidified therein can flow again. This embodiment requires little energy, since such energy need be supplied only to deactivate the permanent magnet 8.

Figure 7:
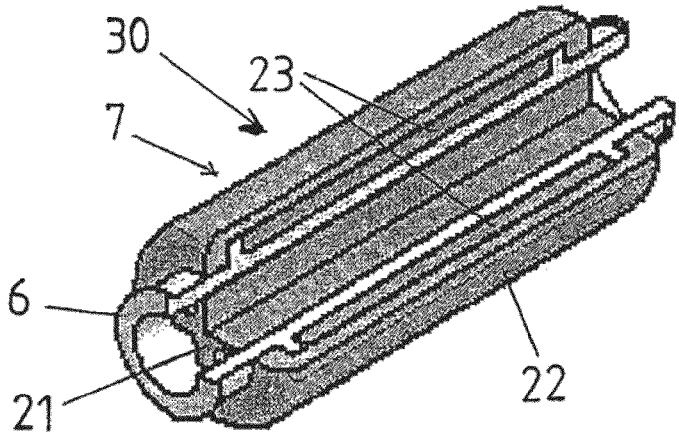
FIG. 7 is a diagrammatic, perspective view of a flow link between two chambers with an associated electromagnet.

FIG. 7 shows a cut-open oblique view of the flow link 7 and an associated electromagnet 20. The line 6 that contains the magnetorheological fluid is, for example provided with a cruciform iron core 21, leaving four flow channels free. A winding 23 surrounds the line 6, and is itself surrounded by an iron casing 22. When a voltage is applied to the winding 23, then the magnetic field solidifies the magnetorheological fluid, and flow is no longer possible. Once the current flow is switched off, flow can pass through the link 7 again.

Figure 8:
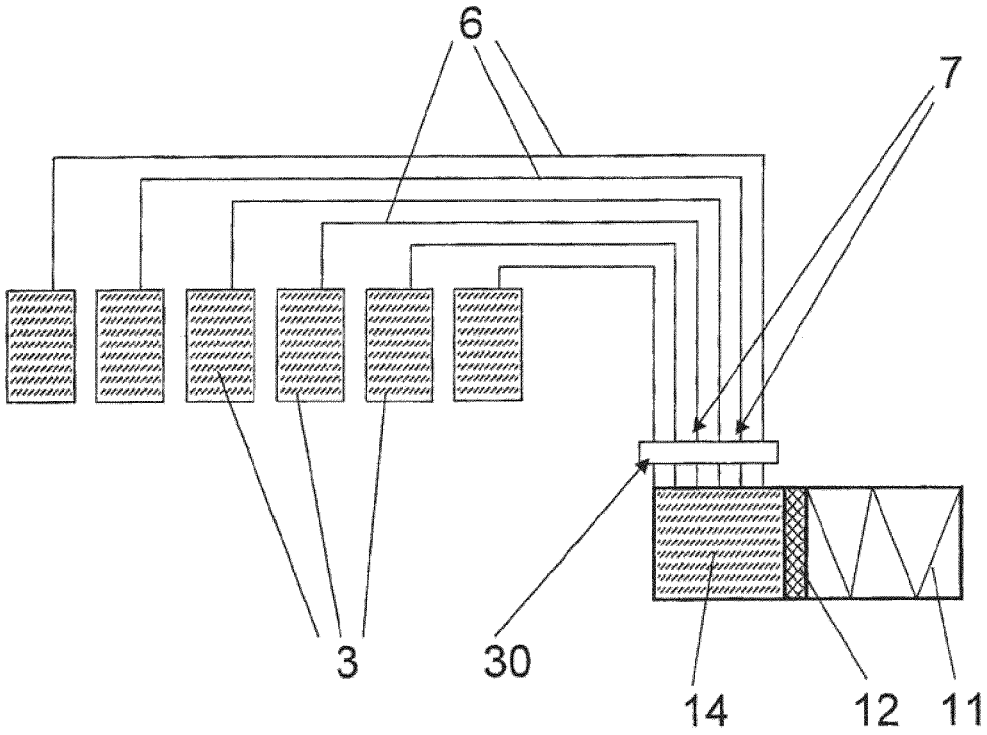
FIG. 8 is a schematic illustration of a configuration of a plurality of chambers which can be influenced in parallel.
Figure 11:
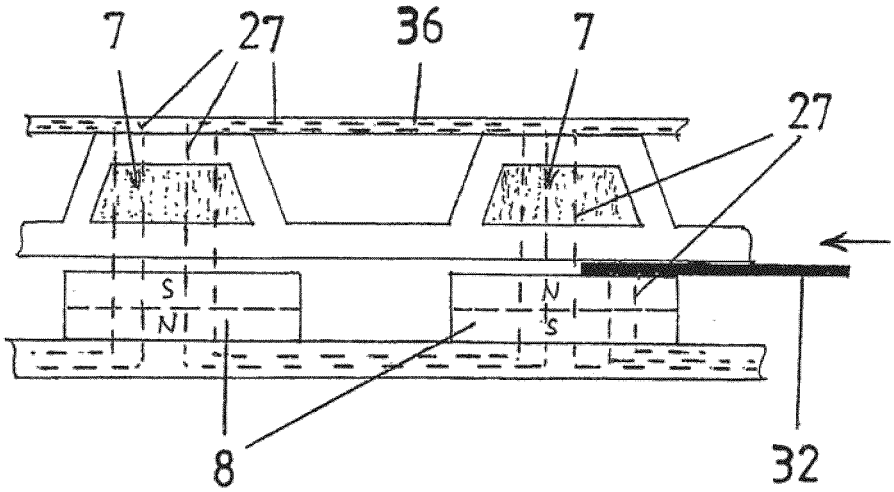
FIG. 11 is a schematic illustration of a configuration of a moveable shield.

FIG. 8 shows, schematically, a parallel arrangement of chambers 3, to each of which a line 6 is passed from the supply container 14. The supply container 14 has an associated pump 12, which is operated by the motor 11. Also, instead of the motor 11 as the power source, the piston of the pump 12 may have an associated schematically shown compression spring or some other pressure generator, possibly also a hand pump or the like. Close to the supply container, the flow links 7, on which the already described constrictions 29 (FIG. 10) are preferably provided, have an associated common device 30, for example in the form shown in FIG. 11, in order to produce a magnetic field. On the opposite side of the flow links 7 to the permanent magnets 8, which flow links 7 preferably have an essentially rectangular or, as shown, trapezoidal cross-sectional shape, FIG. 11 shows a layer 36 composed of a magnetic material, for example an iron plate or an iron sheet, a magnetic film or the like, so that the magnetic field lines 27 are closed, and the flow links 7 pass through at right angles to the flow direction. The strength of the field or of the permanent magnet or magnets 8 can now be varied by inserting a shield 32 between the flow links 7 and the permanent magnets 8, which can be done by hand or, for example, by a motor drive. This is illustrated on the right-hand side of FIG. 11, in which the outermost magnetic field lines 27 have already been deflected by the shield and no longer pass through the flow link 7. In simple terms, the magnetorheological fluid is liquid in the area of the shielded magnetic field lines 27, and is solidified in the area of the unshielded magnetic field lines. The movement of the shield 32 from the illustrated position leads either to complete opening of the flow link 7 (insertion in the direction of the arrow) or to its complete closure (removal in the opposite direction).

Figure 12:
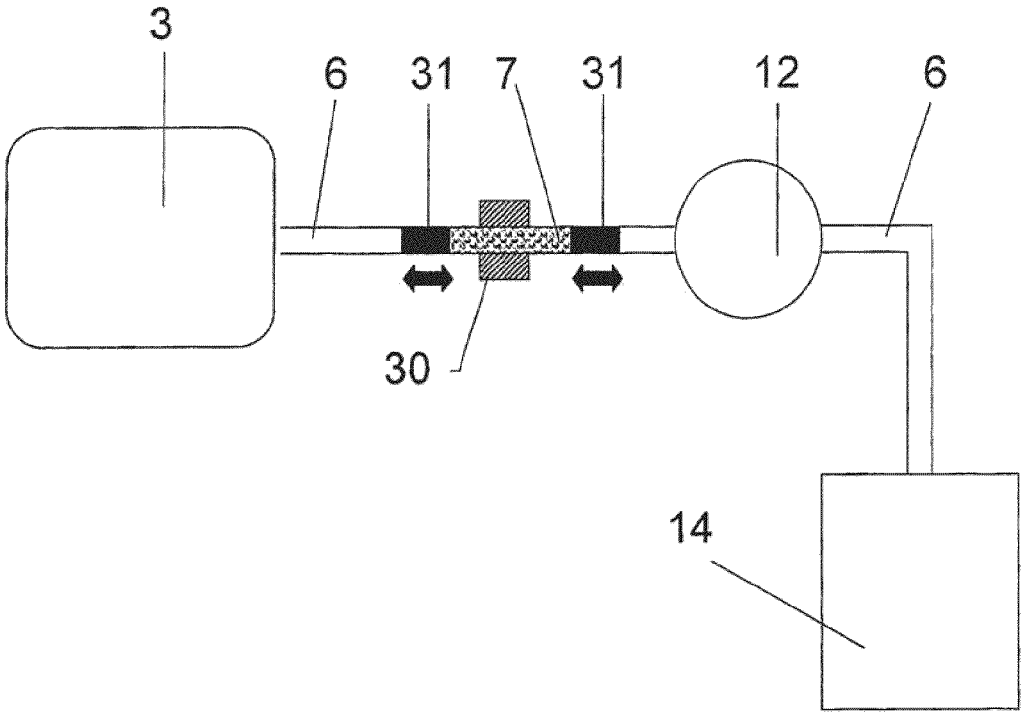
FIG. 12 is a schematic illustration of a variant in which the magnetorheological fluid is provided only in the flow link.

In the embodiment shown in FIG. 12, the magnetorheological fluid is restricted to the area of the flow link 7, and is sealed in the line 6 at both ends by a sealing element 31 against the medium which is used in the other areas and, in particular, costs less and/or is lighter.

If equalization is intended to take place between the supply container 14 and the chamber 3, for example in order to dissipate any overpressure which may occur in the chamber 3 as a result of swelling of the foot, then the magnetic field of the device 30 is attenuated or cancelled out, and the excess medium is forced into the line 6. The magnetorheological fluid can be moved to the right, together with the sealing elements 31. The appropriate amount of the medium in the line 6 leading to the supply container is pumped back into the supply container. As soon as equalization has been achieved, the magnetic field is produced again, and the magnetorheological fluid in the flow link 7 solidifies. The new state is thus ensured.

Figure 13:
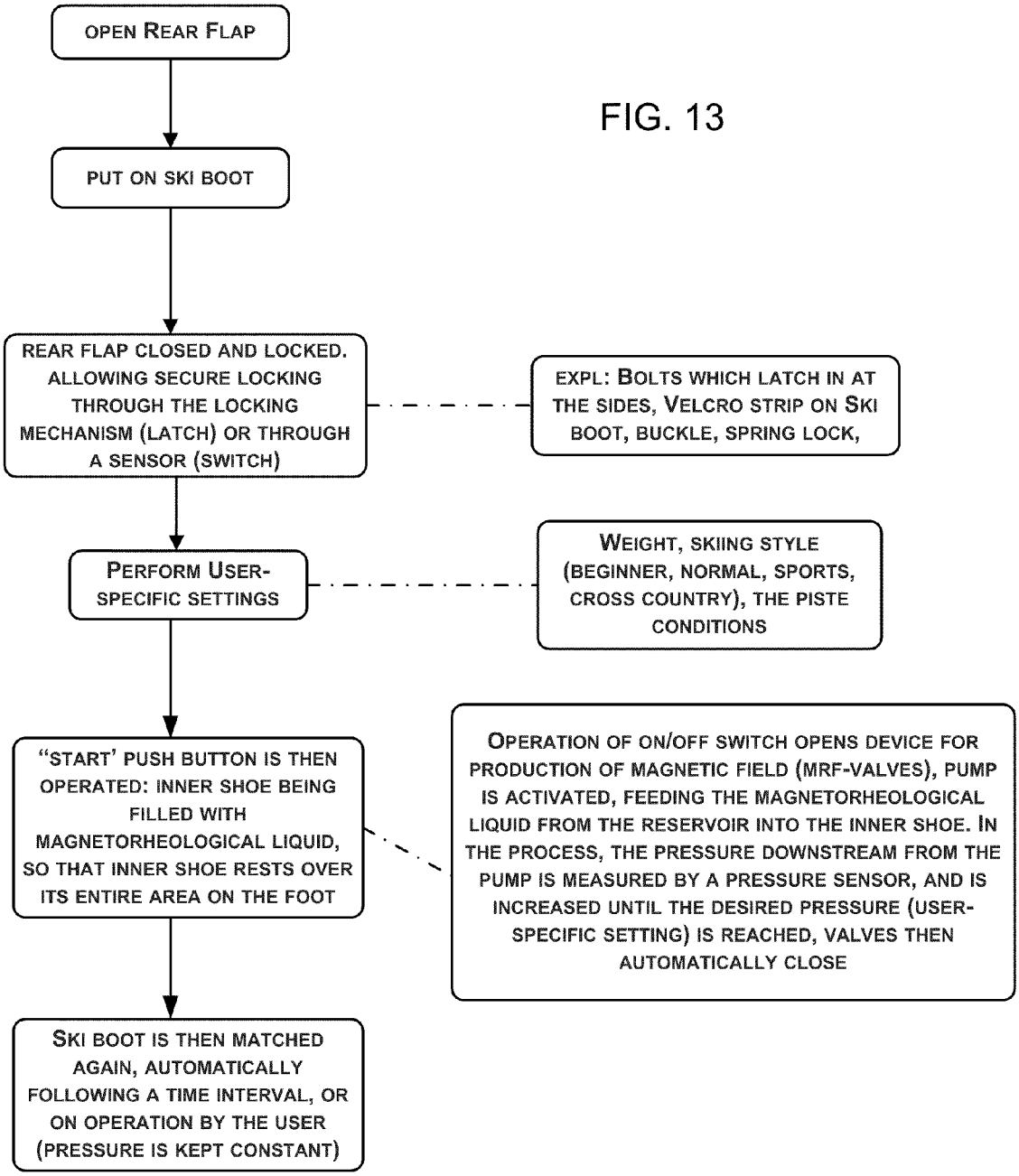
FIG. 13 is a flowchart for use of a ski boot according to the invention.

FIG. 13 shows a block diagram of the major steps for use of the ski boot according to the invention, starting with the opening of the rear flap. The ski boot is then fitted and the rear flap closed and locked. In this case, the locking mechanism (latching in) or a sensor (switch) ensures secure closure. For example bolts which latch in at the side, Velcro strip around the ski boot, buckle, snap-action closure, etc. The user-specific settings are then made, specifically corresponding to the weight, the skiing style (beginner, normal, sports, cross country), the piste conditions etc. A "start" push button is then operated, resulting in the inner shoe being filled with magnetorheological fluid, so that the inner shoe rests over its entire area on the foot. Operation of the on/off switch opens the devices for production of the magnetic field (MRF valves) and the pump is activated, feeding the magnetorheological fluid from the reservoir into the inner shoe. In the process, the pressure downstream from the pump is measured by a pressure sensor, and is increased until the desired pressure (user-specific setting) is reached. The valves are then automatically closed. Subsequently, the ski boot is then matched again, automatically following a time interval, or on operation by the user (and, for example, the pressure is kept constant).

FIG. 14 pertains to a further exemplary implementation of the invention. Here, the system is shown in an orthotic context with an orthosis device that is integrated in a running shoe with an adjusting unit for adjusting pronation. The term "pronation" concerns the rolling of a foot from the lateral, posterior side to the inner, medial side. Pronation is quite typical and, in fact, necessary to achieve proper positioning of the foot. It may, however, lead to injuries of the foot, the leg, or even the hip when a runner pronates excessively. This is called over-pronation. Runners who over-pronate land on the outer side of the heel in a supinated position and then roll medially across the heel towards the inside of the footwear beyond a point which may be considered normal. A certain amount of pronation is helpful, because pressure and stress on the leg is decreased. Overly strong pronation, on the other hand, causes extraneous stress on the joints. Similarly, the exemplary embodiment shown in FIG. 14, also deals with supination—rolling the foot inside-out. Over-supinating may lead to injuries similar to those caused by over-pronating.

In the valve of FIG. 14, a portion of the magnet circuit (47, 43, 52) is formed, at least partially, of hard-magnetic material. This will be further described below with reference to the explanation concerning remanence or rententivity.

According to FIGS. 14 and 15, the adjustment unit of the running shoe contains a compressible container 41 that is filled with a magnetorheological fluid and that is equipped with a compressible container part 44 as well as with a non-compressible discharge channel 46 adjacent to it in axial direction of the compression. The discharge channel having an opening 42. As the sole hits the running surface, the running shoe collapses and the fluid in the container 41 is pressed through the opening 42 into the flow-off pipe 45 when the container is compressed. At the transition from the container to the discharge channel 46, a counterforce is created that influences the ejection criteria of the fluid to the effect that the compression to a predetermined end position, i.e., the process, is controlled. For this purpose, the discharge channel 46 is surrounded by a mechanism 40 for the generation of an alterable magnetic field. The mechanism 40 comprises an electromagnet via which a magnetic field is created or the magnetic field of a permanent magnet 52 is influenced. The electromagnet can be controlled by an electronic system 58 via signals from sensors monitoring das(?) compression and the adjustment path in dependence of various criteria such as the step length, the running surface, the weight of the runner, the speed of the runner, etcetera, with the alterable magnetic field changing the viscosity of the magnetorheological fluid that is to be forced through the opening.

The counterforce or the force opposing the flow-through is controlled (i.e., driven) in accordance with specific requirement. A counterforce that is not strong enough during the changeover from one lifting position into another lifting position leads to a very quick change in position and a very fast drive oscillation. In other words, the change from the base position (i.e., the malleable container 41 has its greatest length) to the shortest compression (i.e., the container 41 has its smallest length) would cause the runner an uncomfortable feeling, such as a sudden collapse.

It is also possible, in this context, to distribute the adjustment over several steps. This would be particularly suitable when the adjustment is a large adjustment.

The force can be increased within milliseconds such that the flow-through is stopped entirely and that the desired position/alignment of the container 41 is set, as shown in FIG. 16. For this purpose, the sole of the running shoe is inclined sideways (i.e., tilted outwardly) so as to result in more support for the inside of the foot. This adjustment may be advantageous, for example, in the context of over-pronation. Depending on the stiffness of the shoe, the foot space adapts to the new situation and the runner assumes an advantageous foot position within the shoe. The dashed line in FIG. 16 indicates a disadvantageous form of the shaft of the shoe without foot space adjustment.

The permanent magnet 52 surrounds the discharge channel and is arranged outside a coil 51 with the aid of which the magnetic flow can be decreased or diverted. The magnetic flux field closes via the magnetically contuctive core 47.

Under the effect of the permanent magnet 52, the magnetorheological fluid in the discharge channel 46 is substantially solid and becomes flowable as soon as the current flows through the coild 51. Since the control of the coil 51 is selectable and variable (i.e., alterable), the viscosity of the fluid is variable (i.e., alterable) as well and the energy absorption is variable. In lieu of the permanent magnet as shown, a simple arrangement of an electromagnet all around the discharge channel 46 is possible as well.

The device 41 prevents the medium from accidentally flowing off, which means that the electromagnet needs to be activated only in the event of a required adjustment in order to increase the viscosity of the magnetorheological medium and thus the compression and positional change. Depending on the implementation and the desired functionality, or the request of the user (or even his/her doctor), the shoe may be further expanded with dampening material 59.

The valve units shown in FIGS. 14 to 16 may be provided and interconnected in any number and strategic distribution by way of flow lines. It is thereby advantageous for the chamber 43 and the further parts (53, et seq.) to be provided only once per unitary unit. If, for instance, the medial (inner) and lateral (outer) valve units are connected to one another, it may be possible to even do without the chamber 43 and its ancillary units (53, et seq.), sionce the magnetorheological fluid then flows from one valve unit to the other, without requiring the additional reservoir and/or the additional compressible container 41. Here, the fluid flows from one compressible container 41 to the other compressible container(s) 41 and thus increases the content volume there. Starting out from an intermediate, center position, this leads to a very fact adjustment and tilting of the shoe (i.e., the inside sole support). Instead of compressing a compressible container 41 by, say, 3 mm to cause the tilting, it is only necessary to compress a single container 41 by 1.5 mm to cause the other container to expand by 1.5 mm.

The valve 53 enables filling of a compressible medium, such as, for instance, air 54, to be filled into the chamber 43. The filling pressure may thereby vary and it may be adapted to the runner's weight, for example. Small filling pressures (small counterpressure) result in very fast position changes and fast changeover movement, which may cause an uncomfortable feeling, as noted above.

The valves 53 illustrated in FIGS. 14-16 are preferably disposed so as to be fillable from outside the shoe and/or they are integrated in the sole. The compressible container 41 may be formed of a plastic, a fiber-reinforced plastic or a bellows, or it may be formed of a metal. It is also possible to form the container such that it provides a counter-pressure on being compressed, similar to a spring, which dampens a fast compression and which supports the retraction into the position of repose.

The coil that drives the magnetic field and consequently the damping action, is supplied with current via a line 57 from a central electronic control unit 58. Sensors deliver the basic data for the movement of the running shoe.

In this running shoe, the magnetic field of the valve can be generated permanently by means of a magnetic device consisting at least partially of hard-magnetic material. In this case, the magnetization of the hard-magnetic material may be varied permanently by means of at least one magnetic pulse from the coil, in order to vary permanently the magnetic field acting in the control duct and consequently the flow resistance of the valve. This is advantageous when longer-lasting operating states with invariableadjustment, such as, for example, even walking over lengthy distances, occur. For this purpose, the valve does not require energy permanently, thus greatly increasing the possible overall utilization time. Nevertheless, the valve reacts in the millisecond range to desired changes, so that this fixing of the magnetic field by means of retentivity is not detrimental to the comfort of the running shoe wearer.

The comfort when wearing a ski boot according to the invention is considerably improved since the internal shape of the foot area 1 can be varied and can be matched to the foot directly, at least when required, not only by convenient operation by removal and insertion of the permanent magnets, by adjustment of a rotary knob etc., but also by using electrical energy for operation.

Retentivity is also referred to as remanence or, more descriptively, as residual magnetism. Valves according to the prior art can be designed with a permanent magnet so that they do not require any energy at a specific operating point. Any deviation from this operating point, whether it be an intensification or an attenuation of the magnetic field, in order to achieve a greater or lesser pressure difference requires energy. In many applications, however, a preferred operating point which is present for a major part of the operating time cannot be determined. This is the case, for example, with a valve which is as often completely open and completely closed.

Precisely in the case of a mobile application, such as, for example, a valve in a running shoe for setting the pronation (e.g., FIG. 14), where other settings and damping properties are required, depending on the wearer and the activity, optimization with respect to an operating point is not advantageous and the permanent energy demand is a considerable disadvantage.

In a valve according to the invention, this problem is solved in that the magnetic field can be generated permanently by means of a magnetic device consisting at least partially of hard-magnetic material. In this case, the magnetization of the hard-magnetic material may be varied permanently by means of at least one magnetic pulse from the coil, in order to vary permanently the magnetic field acting in the control duct and, consequently, the flow resistance of the valve.

In contrast to the prior art, where the magnetic field of the magnet can be varied by the magnetic field of the coil only as long as current flows in the coil, a valve according to the invention can permanently vary the magnetization of the magnetic device via magnetic pulses from the coil. As a result, for example, the magnetic properties of the magnetic device can be varied permanently by means of a single short pulse which requires energy only briefly. Energy is therefore required only in order to change the field strength in the control duct.

The magnetic field generated by the magnetic device in the control duct acts without a supply of energy and maintains its field strength permanently, as long as it is not influenced by external circumstances, such as, for example, other magnetic fields, temperature influences or natural aging processes.

Preferably, the permanent magnetization of the hard-magnetic material can be set to any desired value between zero and retentivity by means of at least one magnetic pulse from the coil. In this case, preferably, the polarity of the magnetization may also be variable.

A dynamic magnetic field may be superimposed upon this static magnetic field by means of the coil, without the permanent magnetization of the hard-magnetic material being varied as a result.

The term "permanent," in the context of this application, means a period of time which is longer by a multiple than the duration of the magnetic pulse. In particular, periods of time of at least several seconds, minutes, hours, days or longer are meant by this. However, the set magnetization does not expressly have to remain the same forever, since it may be subject to natural fluctuations and attenuation phenomena.

In contrast to this, the time duration of the magnetic pulse required for variation is relatively short. The time duration of the, in particular, single brief pulse in this case preferably lies below 1 minute, preferably below 1 second and, in particular, below 10 milliseconds. The intensity of magnetization depends on the strength of the magnetic pulse, but not on the length of the magnetic pulse.

A material is deemed to be hard-magnetic when its coercivity lies above 1 kA/m and, in particular, above 10 kA/m. The hard-magnetic material preferably has a coercivity lower than 1500 kA/m, preferably lower than 500 kA/m and, particularly preferably, lower than 200 kA/m. A suitable material is, for example, AlNiCo or a magnetic steel alloy, such as, for example, FeCrCo, FeCoVCr and CuNiFe, or another material having comparable magnetic properties. Advantages of AlNiCo are the profile of the demagnetization curve, the high temperature stability and the good chemical properties in relation to other conventional magnetic materials.

The hard-magnetic material, on the one hand, must be capable of generating a high magnetic field strength in the existing magnetic circuit, while, on the other hand, the energy required for magnetic reversal should not be too great. It is conceivable to manufacture only part of a magnetic device from hard-magnetic material and to manufacture the rest from a material having low magnetic resistance (reluctance) and a high saturation flux density. Advantageously, this part of the magnetic device is arranged in the coil or in its immediate vicinity, since the coil field for magnetic reversal is the strongest there and can also be controlled best there.

It is, however, also possible to manufacture the entire magnetic device from hard-magnetic material, in which case relatively more material is available for generating the field, or the magnetic requirements to be satisfied by the material become lower.

The field strength of the coil that may be generated is preferably sufficient to magnetize the hard-magnetic parts of the magnetic device up to their magnetic saturation.

Preferably, at least one capacitor device and at least one energy accumulator, in particular a battery, are provided, in order to make available the energy for generating at least one magnetic pulse. As a result, the valve also possesses excellent emergency running properties, for example if the energy supply collapses or the control fails. A defined operating state of the valve can be ensured by means of a defined current pulse.

In all refinements, preferably, at least one control and/or check device is provided, in order to output magnetic pulses from the coil in a controlled and/or regulated manner.

To detect the actual data and/or the position of the valve, at least one sensor device may be provided. Sensors for the direct or indirect determination of the magnetization of the magnetic device may be used. These sensors or their measurement results may be employed by a control or regulating device in order to determine the strength of the magnetic pulses to be generated.

Preferably at least one resonant circuit device is provided, so that a damped magnetic alternating field for demagnetization can be generated. The demagnetization of the hard-magnetic material may take place via a damped magnetic alternating field or via at least one defined magnetic pulse. It is possible, before any change in magnetization, first to demagnetize the magnetic device and then to magnetize it anew.

The inventive subject of the present invention may be gathered not only from the subject matter of the individual patent claims, but also from the combination of the individual patent claims with one another.

All the particulars and features, in particular the three-dimensional design illustrated in the drawings, which are disclosed in the documents, including the abstract, are claimed as essential to the invention, insofar as they are novel, as compared with the prior art, individually or in combination.

The invention is explained in more detail below by means of drawings which illustrate only one way of implementation. At the same time, further features essential to the invention and advantages of the invention may be gathered from the drawings and their description.

In yet another exemplary implementation of the invention, the novel system may be integrated in a cast or an emergency setting cast for support of a broken bone or ligament. Again, similarly to the description of the ski boot above, the foot space may be individually adjusted and adapted.

The invention claimed is:

1. A shoe with a foot space, comprising:

one or more deformable chambers disposed to vary a shape and/or a volume of the foot space in the shoe;

a supply container and one or more flow links fluidically connecting said supply container to respective said deformable chambers;

an amount of magnetorheological fluid (MRF) in said supply container, in said one or more deformable chambers and in said one or more flow links; and at least one magnet device for generating a magnetic field, said magnet device being disposed to subject at least one of said flow links and said deformable chambers to the magnetic field, said magnet device selectively influencing a viscosity of said magnetorheological fluid and varying the shape and/or the volume of the foot space by varying the magnetic field.

2. The shoe according to claim 1, wherein said flow links are valves and flow lines through which said MRF flows out of and into respective said deformable chambers, and said magnet device is disposed to generate the magnetic field in said flow links.

3. The shoe according to claim 1, wherein said one or more deformable chambers are at least two separate chambers having a flow link channel fludically connected therebetween, and said magnet device is disposed at said flow link channel to selectively influence a flow of said MRF between said two chambers.

4. The shoe according to claim 1, which further comprises a supply container with MRF for supplying MRF to said one or more deformable chambers and wherein said magnet device is disposed adjacent to channels interlinking said supply container with said one or more deformable chambers.

5. The shoe according to claim 2, wherein said magnet device is one of a plurality of magnet devices each associated with a respective said flow link.

6. The shoe according to claim 1, wherein said at least one magnet device includes a permanent magnet.

7. The shoe according to claim 6, wherein said permanent magnet is disposed to move relative to said flow links to attenuate or deactivate the magnetic field.

8. The shoe according to claim 7, wherein said permanent magnet is removably disposed in the shoe.

9. The shoe according to claim 6, which comprises a movable and removable magnetic shield for attenuating or deactivating the magnetic field.

10. The shoe according to claim 9, further comprising at least one motor for moving said magnetic shield.

11. The shoe according to claim 6, wherein said permanent magnet has an associated switchable electromagnet to attenuate or deactivate the magnetic field of said permanent magnet.

12. The shoe according to claim 1, wherein said magnet device has at least one switchable electromagnet.

13. The shoe according to claim 1, wherein each of said flow links has a constriction disposed approximately centrally in the magnetic field.

14. The shoe according to claim 1, wherein the shoe is a ski boot.

15. The shoe according to claim 1, wherein said flow link comprises a housing, iron cores, and a permanent magnet disposed to form a magnetic circuit, said permanent magnet having at least partially hard-magnetic properties with a coercivity above 1 kA/m.

16. The shoe according to claim 1, wherein said flow link comprises a housing and iron cores disposed to form a magnetic circuit, said iron cores having at least partially hard-magnetic properties.

17. The shoe according to claim 16, wherein said hard-magnetic material is a material with a magnetization that is permanently variable by at least one magnetic pulse from a coil of said magnet device.

18. The shoe according to claim 16, wherein said hard-magnetic material is a material with a magnetization that may be attenuated or completely canceled by way of a magnetic alternating field of the coil.

19. The shoe according to claim 16, wherein said hard-magnetic material is a material with a magnetization that is infinitely variable from a zero value to a retentivity of the material by way of at least one magnetic pulse from a coil of said magnet device.

20. The shoe according to claim 16, wherein said hard-magnetic material is a material with a magnetization having a polarity that is reversible by way of at least one magnetic pulse from a coil of said magnet device.

21. The shoe according to claim 16, which further comprises a current source selected from the group consisting of a battery, a capacitor, an accumulator, and a vibration generator for supplying energy for at least one magnetic pulse from the coil.

22. The shoe according to claim 1, wherein each of said flow links has two sealing elements moveable within said flow links, said magnetorheological liquid in each of said flow links is enclosed by said two sealing elements and is separated from a different compound, which can flow, in said deformable chambers.

23. Skiing equipment, comprising:

a ski with a ski binding;

a ski boot configured to be clamped to said ski binding, said ski boot having a foot space for receiving a foot of a skier, said ski boot including:

a plurality of deformable chambers disposed to vary a shape and/or a volume of the foot space in the shoe;

a supply container and one or more flow links fluidically connecting said supply container to said deformable chambers;

an amount of magnetorheological fluid (MRF) in said supply container, in said deformable chambers and in said one or more flow links;

at least one magnet device for generating a magnetic field disposed to subject at least one of said flow links to the magnetic field, said magnet device selectively influencing a viscosity of said magnetorheological fluid and varying the shape and/or the volume of the foot space by varying the magnetic field; and an electrical energy source connected to said magnet device for supplying electrical energy for energizing said magnet device.

24. The skiing equipment according to claim 23, wherein said electrical energy source has a generator for converting vibration movements into the electrical energy.

25. The skiing equipment according to claim 23, further comprising a control system connected to drive said magnet and/or said flow links.

* * * * *